US010620578B2

(12) United States Patent
Sakurada et al.

(10) Patent No.: US 10,620,578 B2
(45) Date of Patent: Apr. 14, 2020

(54) IMAGE FORMING APPARATUS FOR CORRECTING DENSITY UNEVENNESS

(71) Applicants: Kohhei Sakurada, Kanagawa (JP); Katsuya Akiba, Kanagawa (JP); Yasuhito Shinchi, Kanagawa (JP); Shinichi Akatsu, Kanagawa (JP); Tetsuya Muto, Tokyo (JP); Hiroki Yamamura, Kanagawa (JP)

(72) Inventors: Kohhei Sakurada, Kanagawa (JP); Katsuya Akiba, Kanagawa (JP); Yasuhito Shinchi, Kanagawa (JP); Shinichi Akatsu, Kanagawa (JP); Tetsuya Muto, Tokyo (JP); Hiroki Yamamura, Kanagawa (JP)

(73) Assignee: Ricoh Compnay, Ltd., Tokyo (JP)

( * ) Notice: Subject to any disclaimer, the term of this patent is extended or adjusted under 35 U.S.C. 154(b) by 0 days.

(21) Appl. No.: 16/162,619

(22) Filed: Oct. 17, 2018

(65) Prior Publication Data

US 2019/0163108 A1 May 30, 2019

(30) Foreign Application Priority Data

Nov. 29, 2017 (JP) ..... 2017-229672

(51) Int. Cl.
*G03G 15/00* (2006.01)
*G03G 15/02* (2006.01)
*G03G 15/043* (2006.01)

(52) U.S. Cl.
CPC ..... *G03G 15/5041* (2013.01); *G03G 15/0266* (2013.01); *G03G 15/043* (2013.01); *G03G 15/5016* (2013.01); *G03G 15/5062* (2013.01); *G03G 15/55* (2013.01); *G03G 15/5025* (2013.01); *G03G 15/5058* (2013.01)

(58) Field of Classification Search
CPC ..... G03G 15/5041; G03G 15/0266; G03G 15/043; G03G 15/5004; G03G 15/5016; G03G 15/55; G03G 15/5025; G03G 15/5058; G03G 15/5062; G03G 15/556
See application file for complete search history.

(56) References Cited

U.S. PATENT DOCUMENTS

2002/0159107 A1 10/2002 Maruta et al.
2014/0255046 A1* 9/2014 Takemura ..... G03G 15/5062 399/15

FOREIGN PATENT DOCUMENTS

JP 2002-172817 6/2002
JP 2014-170195 9/2014

* cited by examiner

*Primary Examiner* — Joseph S Wong
(74) *Attorney, Agent, or Firm* — Harness, Dickey & Pierce P.L.C.

(57) ABSTRACT

An image forming apparatus includes an image forming device to form an image on an image bearer and circuitry configured to accept, from a user, an input of a density level selected from a plurality of different density levels and control an image forming condition under which the image forming device forms the image. The circuitry is configured to correct density unevenness of the image formed on the image bearer by the image forming device and correct the density unevenness of the image at the density level accepted. The density unevenness is unevenness appearing in a main scanning direction orthogonal to a direction of conveyance of the image bearer during image formation.

17 Claims, 15 Drawing Sheets

IMAGE FORMING APPARATUS FOR CORRECTING DENSITY UNEVENNESS

CROSS-REFERENCE TO RELATED APPLICATIONS

This patent application is based on and claims priority pursuant to 35 U.S.C. § 119(a) to Japanese Patent Application No. 2017-229672, filed on Nov. 29, 2017, in the Japan Patent Office, the entire disclosure of which is hereby incorporated by reference herein.

BACKGROUND

Technical Field

This disclosure relates to an image forming apparatus.

Description of the Related Art

In apparatuses such as multifunction peripherals (MFP) that form images on recording media such as paper, shading correction is performed for correcting uneven density in a main scanning direction, which is orthogonal to the direction in which the recording medium is conveyed.

For example, there are apparatuses that detect a pattern printed on paper, determine whether correction is necessary, and, if necessary, perform shading correction in the main scanning direction, to reduce workload of a user and downtime of the apparatus.

SUMMARY

According to an embodiment of this disclosure, an image forming apparatus includes an image forming device to form an image on an image bearer and circuitry configured to accept, from a user, an input of a density level selected from a plurality of different density levels and control an image forming condition under which the image forming device forms the image. The circuitry is configured to correct density unevenness of the image formed on the image bearer by the image forming device and correct the density unevenness of the image at the density level accepted. The density unevenness is unevenness appearing in a main scanning direction orthogonal to a direction of conveyance of the image bearer during image formation.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
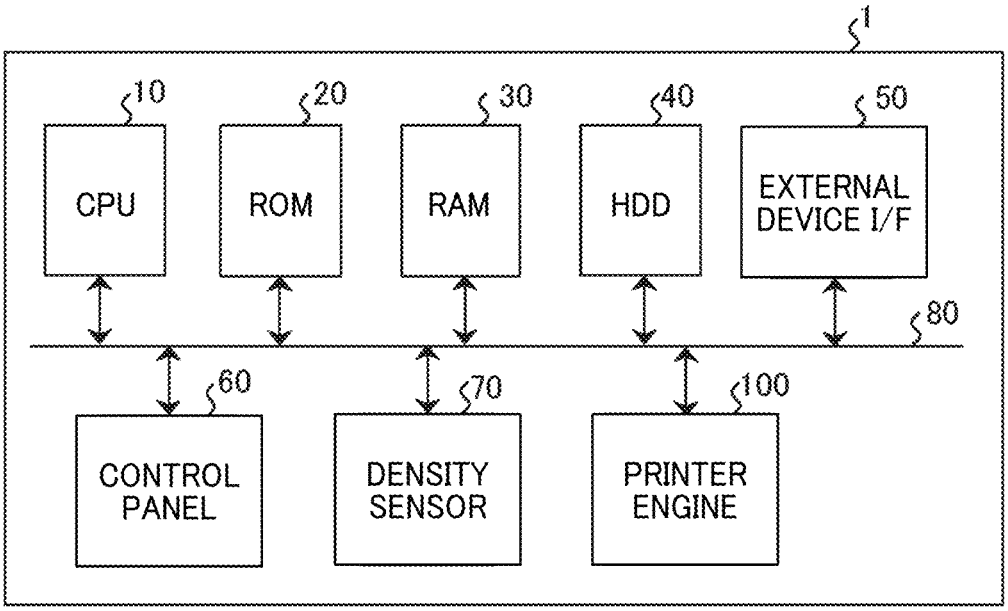
FIG. 1 is a schematic block diagram illustrating a hardware configuration of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming apparatus according to an embodiment of this disclosure is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a block diagram illustrating a hardware configuration of an image forming apparatus 1 according to the present embodiment. The image forming apparatus 1 is a multifunction peripheral (MFP) having a plurality of functions such as a copy function, a facsimile (FAX) function, a print function, a scanner function, a function of image processing on an input image (an image input through scanning of a document or input by a printer or facsimile function) and storing and distribution of the input image. In the present embodiment, the "image" processed by the image forming apparatus 1 includes, in addition to image data, data without image data, that is, data including only text information.

FIG. 1 is a schematic block diagram illustrating a hardware configuration of the image forming apparatus 1. The image forming apparatus 1 illustrated in FIG. 1 includes a center processing unit (CPU) 10, a read only memory (ROM) 20, a random access memory (RAM) 30, a hard disk drive (HDD) 40, an external device interface (I/F) 50, a control panel 60, a density sensor 70, and a printer engine 100. These components are connected to each other via a system bus 80.

The CPU 10 controls operation of the image forming apparatus 1. The CPU 10 executes programs stored in the ROM 20 or the HDD 40, using the RAM 30 as a work area, to control the entire operation of the image forming apparatus 1. Thus, the CPU 10 implements various functions such as copying, scanning, facsimile communication, and printing functions described above.

The ROM 20 is a nonvolatile semiconductor memory (a storage device) capable of holding data even after the power is turned off. The RAM 30 is a volatile semiconductor memory that temporarily stores programs or data.

The HDD 40 is a nonvolatile memory that stores programs or data. Programs and data stored in the HDD 40 include an operating system (OS), which is basic software for controlling the entire image forming apparatus 1, various application programs operating on the OS, and operation conditions of various functions such as the copy function, the scanner function, the facsimile function, and the printer function mentioned above. The HDD 40 can further store execution of each of such functions (hereinafter also "job") each time as operation logs of the image forming apparatus 1.

The external device I/F 50 is an interface device to allow the image forming apparatus 1 to communicate with an external device through a network such as the Internet and a local area network (LAN). The image forming apparatus 1 can receive a print instruction, image data, and the like from an external device via the external device I/F 50.

The control panel 60 accepts various inputs corresponding to operation of an operator (or user) and displays various types of information such as information indicating the operation accepted, information indicating the operational status of the image forming apparatus 1, and information indicating the setting of the image forming apparatus 1. In one example, the control panel 60 is, but not limited to, a liquid crystal display (LCD) having a touch panel function. Another example usable is an organic electro luminescence (EL) display having a touch panel function. In alternative to or in addition to the LCD or the EL display, the control panel 60 can include an operation unit such as hardware keys, a display unit such as an indicator lamp, or both. The control panel 60 is controlled by the CPU 10.

The printer engine 100 serving as an image forming device is hardware for implementing the printer function, the copy function, a facsimile function, and the like. That is, the printer engine 100 is hardware for printing, copying, facsimile communication, scanning, etc. Adoptable for printing is, but not limited to, electrophotography, inkjet printing, or the like. The image forming apparatus 1 can further include optional devices, such as a finisher to sort printed sheets and an automatic document feeder (ADF) to automatically feed documents. The printer engine 100 is controlled by the CPU 10.

The image forming apparatus 1 further includes an external device interface to read and write data in and from an external recording medium such as a compact disc (CD), a digital versatile disc (DVD), a secure digital (SD) card, a universal serial bus (USB) memory, etc. with the external device interface.

The programs stored in the ROM 20 or the HDD 40 are processable by a computer. Such programs can be installed in the ROM 20 or the HDD 40 during manufacturing or at the shipping of the image forming apparatus 1 or can be installed after sales. For installation after sales, the program can be installed from an external recording medium storing the program via an external recording media drive or downloaded via the network using the external device I/F 50.

Figure 2:
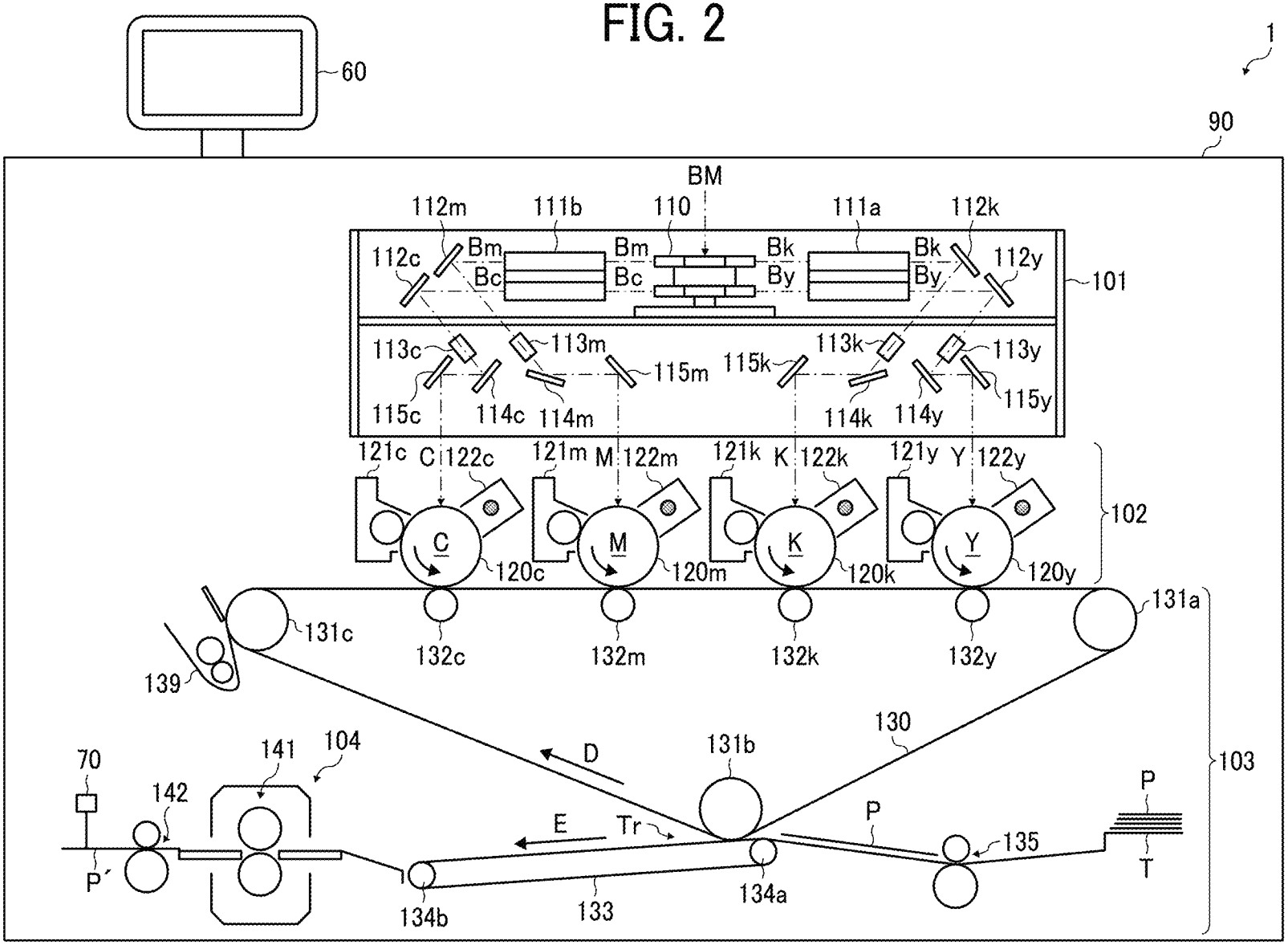
FIG. 2 is a schematic view illustrating a hardware configuration of a printer engine, according to embodiments.

FIG. 2 is a schematic view illustrating a hardware configuration of the printer engine 100. For the sake of explanation, the control panel 60 and the density sensor 70 are also illustrated.

The printer engine 100 is disposed inside a housing 90 and includes an exposure device 101, an image forming unit 102, a transfer unit 103, and a fixing device 104. The control panel 60 is disposed on an upper face of the housing 90.

The image forming unit 102 includes a photoconductor 120*y* for yellow (Y), a photoconductor 120*k* for black (K), a photoconductor 120*m* for magenta (M), and photoconductor 120*c* for a cyan (C), each of which is an image bearer. The image forming unit 102 further includes a developing device 121*y*, a developing device 121*k*, a developing device 121*m*, and a developing device 121*c* for yellow, black, magenta, and cyan, respectively. The image forming unit 102 further includes a charger 122*y*, a charger 122*k*, a charger 122*m*, and a charger 122*c* for yellow, black, magenta, and cyan, respectively.

Further, the transfer unit 103 includes an intermediate transfer belt 130, a secondary transfer belt 133, and the like. The fixing device 104 includes a fixing member 141, a discharge roller 142, and the like.

The operation of the printer engine 100 will be described below with reference to FIG. 2.

The exposure device 101 exposes the photoconductors 120*y* to 120*c* of the image forming unit 102 and emits writing light for writing a latent image corresponding to image data on each photoconductor. In other words, the exposure device 101 emits light beams selectively at writing positions corresponding to the image pattern of the image data and with the intensity of light corresponding to image density. As a light source of the writing light, a laser light source, a light emitting diode (LED), or the like can be used. Hereinafter, a case using a laser light source having a laser diode (LD) will be described as one example.

First, a polygon mirror 110 deflects light beams BM emitted from the laser light source, and each of the light beams BM enters scanning lenses 111*a* and 111*b* each including an fθ lens. A configuration to emit the light beam BM from the laser light source and operation thereof will be described later.

The number of laser rays generated as the light beam BM corresponds to each of yellow, black, magenta, and cyan images. After permeating through the scanning lenses 111*a* and 111*b*, the light beam BM is reflected by reflection mirrors 112*y*, 112*k*, 112*m*, and 112*c*.

For example, a yellow light beam By permeates through the scanning lens 111*a*, is reflected by the reflection mirror 112*y*, and enters a long toroidal (WTL) lens 113*y*. Similarly, black, magenta, and cyan light beams Bk, Bm, and Bc are respectively reflected by the reflection mirrors 112*k*, 112*m*, and 112*c*, and enter WTL lens 113*k*, 113*m*, and 113*c*.

WTL lenses 113*y* to 113*c* shape the incident light beams By to Bac, respectively, and then deflect the light beams By to Bc to the reflection mirrors 114*y*, 114*k*, 114*m*, and 114*c*. The respective light beams By to Bc are further reflected by reflection mirrors 115*y*, 115*k*, 115*m*, and 115*c* and guided to irradiate the photoconductors 120*y* to 120*c* as writing beams used for exposure.

Synchronization of timing of irradiation of the photoconductors 120*y* to 120*c* with the light beams By to Bc are performed with respect to a main scanning direction and a sub-scanning direction on the photoconductors 120*y* to 120*c*. In addition, the photoconductor is, for example, shaped like a drum that is long in the main scanning direction and may be referred to as a photoconductor drum.

Hereinafter, the main scanning direction on the photoconductors 120*y* to 120*c* is defined as the scanning direction of the light beams, and the sub-scanning direction is defined as the direction orthogonal to the main scanning direction, that is, the direction of rotation of the photoconductors 120*y* to 120*c*.

The photoconductors 120*y* to 120*c* include a photoconductive layer including at least a charge generation layer and a charge transport layer on a conductive drum such as aluminum.

The respective photoconductive layers of the photoconductors 120*y* to 120*c* and are charged by the chargers 122*y* to 122*c*, each of which includes a scorotron charger, a scorotron charger, a charging roller, or the like. Thus, the photoconductors 120*y* to 120*c* gain surface charges according to charging biases.

The photoconductors 120*y* to 120 given electrostatic charges by the chargers 122*y* to 122*c* are exposed by the light beams By to Bc as the writing light in accordance with the image pattern, and electrostatic latent images are formed on the surfaces scanned by the chargers 122*y* to 122*c*.

The electrostatic latent images respectively formed on the surfaces of the photoconductors 120*y* to 120*c* are developed by developing devices 121*y* to 121*c* into toner images. Each of the developing devices 121*y* to 121*c* includes a developing sleeve to which a developing bias is applied, a toner supply roller, and a regulation blade.

The respective toner images carried on the photoconductors 120*y* to 120*c* are transferred onto the intermediate transfer belt 130 rotating in the direction indicated by arrow D by conveyance rollers 131*a*, 131*b*, and 131*c*. The toner images are superimposed one on another, forming a multicolor image. Primary transfer rollers 132*y*, 132*k*, 132*m*, and 132*c* (transfer devices) are disposed opposite the photoconductors 120*y*, 120*k*, 120*m*, and 120*c*, respectively.

The toner images are transferred from the photoconductors 120*y* to 120*c* onto the intermediate transfer belt 130 serving as an image bearer. The intermediate transfer belt 130, with the yellow, black, magenta, and cyan toner images carried thereon, is conveyed to a secondary transfer position Tr.

The secondary transfer belt 133 is wound around conveyance rollers 134*a* and 134*b* and conveyed in the direction indicated by arrow E by the conveyance rollers 134*a* and 134*b*.

At the secondary transfer position Tr, a sheet P is fed from a sheet container T such as a sheet feeding tray by a conveyance roller 135. The sheet P is a medium, such as fine paper or a plastic sheet, to receive an image. At the secondary transfer position Tr, with application of a secondary transfer bias, the multicolor toner image borne on the intermediate transfer belt 130 is transferred onto the sheet P attracted and carried onto the secondary transfer belt 133. The sheet P is conveyed in the direction perpendicular to the main scanning direction.

As the secondary transfer belt 133 is conveyed, the sheet P is fed to the fixing device 104.

The fixing device 104 includes the fixing member 141 such as a fixing roller including silicone rubber, fluorine rubber, and the like. The fixing device 104 applies pressure and heat to the sheet P and the multicolor toner image and discharges the sheet P with the discharge roller 142 to the outside of the fixing device 104, as a sheet P' after image formation.

The density sensor 70 detects the image density of the image on the sheet P' (an image bearer) discharged from the fixing device 104. Details of the density sensor 70 will be described later. Image density unevenness is corrected in the main scanning direction based on the image density detected by the density sensor 70. According to the present embodiment, uneven density can be corrected at the density level desired by the user. Accordingly, an image with higher image quality can be obtained.

After the multicolor toner image is transferred from the intermediate transfer belt 130, a cleaning unit 139 including a cleaning blade removes residual toner (developer) from the intermediate transfer belt 130. Then, the intermediate transfer belt 130 is used in a next image forming process.

In the above-described operation of the printer engine 100, the direction of rotation of the photoconductors 120*y* to 120*c* as the image bearers, the direction of rotation of the intermediate transfer belt 130 as the image bearer, and the direction of conveyance direction of the sheet P and the sheet P' (hereinafter "sheet conveyance direction") as the image bearers are orthogonal to the main scanning direction (indicated by arrow MS in FIGS. 3 and 4) and same as the sub-scanning direction (indicated by arrow SS in FIGS. 3 and 4).

In FIG. 2, the density sensor 70 is disposed downstream from the fixing device 104 in the sheet conveyance direction. Alternatively, the density sensor 70 can be disposed, for example, in the vicinity of the conveyance roller 131*a* so that the density sensor 70 can detect the density of the image on the intermediate transfer belt 130.

Figure 3:
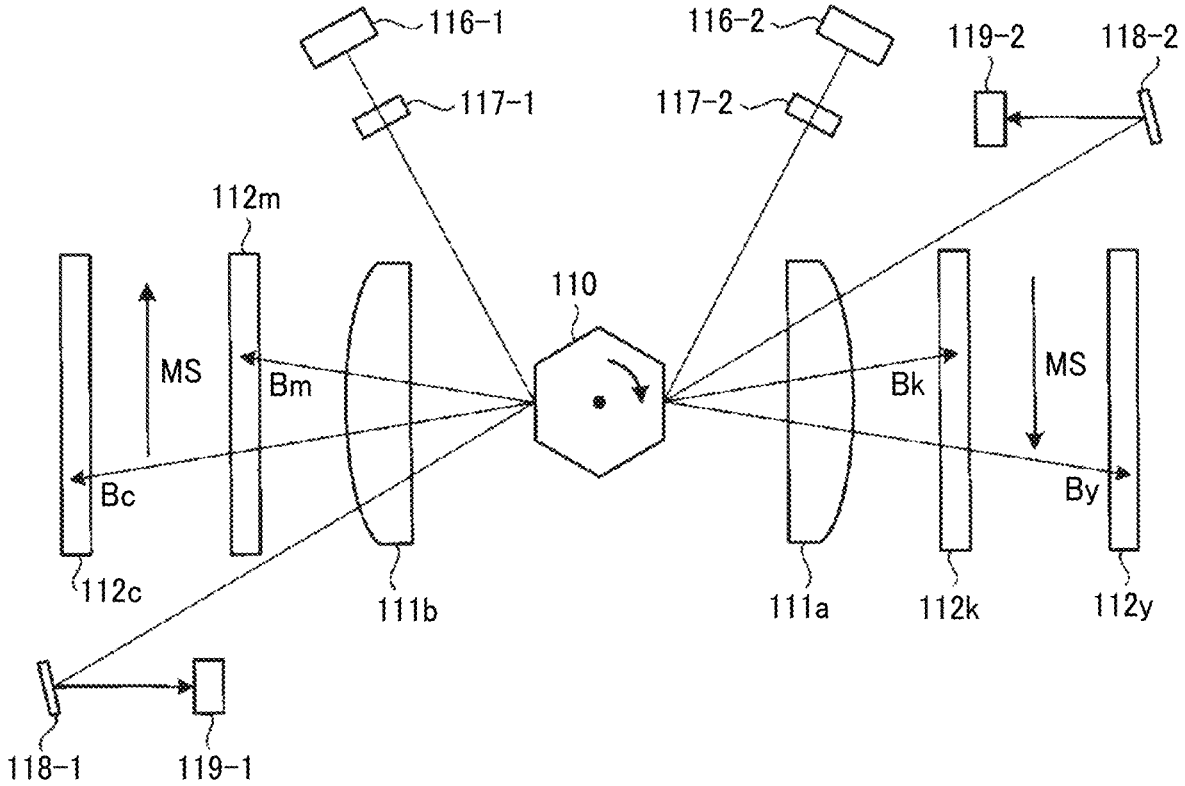
FIG. 3 is a schematic view of a light source unit of an exposure device according to an embodiment.
Figure 4:
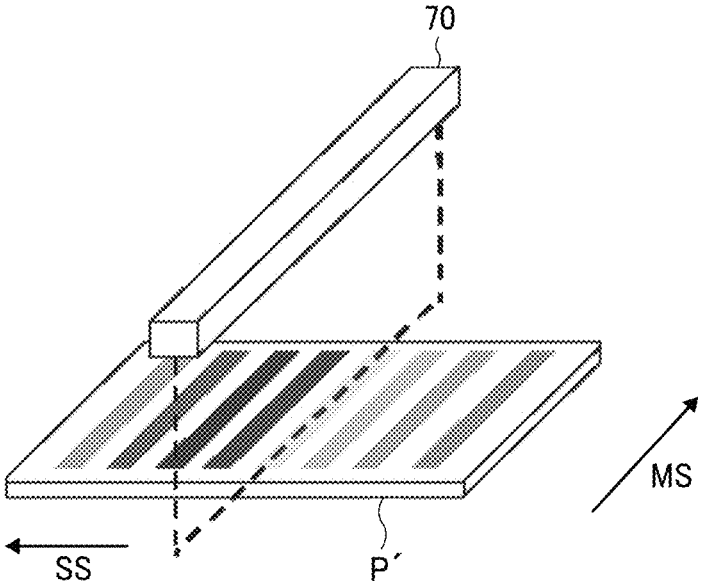
FIG. 4 is a perspective view of a density sensor according to an embodiment.

FIG. 3 is a schematic diagram of a light source unit of the exposure device 101. With reference to FIG. 3, the configuration and operation for exposing the photoconductor with the light beam BM illustrated in FIG. 2 will be described.

The exposure device 101 includes LD units 116-1 and 116-2 as light source units. Each of the LD units 116-1 and 116-2 includes laser elements. Each laser element is driven to selectively output a light beam at a writing position corresponding to image data with a writing light amount corresponding to the image data.

The light beam emitted from the LD unit 116-1 passes through a cylinder lens 117-1 and is directed to the polygon mirror 110 rotated by a polygon motor. An upper portion and a lower portion of the LD units 116-1 include LDs, respectively. For example, the magenta light beam Bm is emitted from the upper LD and directed to the upper portion face of the polygon mirror 110, and the cyan light beam Bc emitted from the lower LD is directed to the lower portion face of the polygon mirror 110.

The magenta light beam Bm directed to the upper portion face of the polygon mirror 110 is deflected as the polygon mirror 110 rotates. The deflected magenta light beam Bm passes through the scanning lens 111*b* and enters the reflection mirror 112*m*. Then, the magenta light beam Bm scans on the photoconductor 120M as described with reference to FIG. 2.

The cyan light beam Bc directed to the lower portion face of the polygon mirror 110 is deflected as the polygon mirror 110 rotates. The deflected cyan light beam Bc passes through the scanning lens 111*b* and enters the reflection mirror 112*c*. Thereafter, the cyan light beam Bc scans on the photoconductor 120C as described with reference to FIG. 2.

A synchronous mirror 118-1 and a synchronous sensor 119-1 are disposed in a non-image writing area, which is in an end portion on a writing start side in the main scanning direction (indicated by arrow MS in FIG. 3), and outward a writing start position in the main scanning direction. The magenta and cyan light beams Bm a d Bc permeating through the scanning lens 111*b* are reflected by the synchronous mirror 118-1 and enters the synchronous sensor 119-1. The synchronous sensor 119-1 outputs synchronization detection signals for determining the timing of start of writing in the main scanning direction of respective colors as the magenta and yellow light beams Bm and, Bc enter the synchronous sensor 119-1.

The light beam emitted from the LD unit 116-2 passes through a cylinder lens 117-2 and is directed to the polygon mirror 110 rotated by a polygon motor. An upper portion and a lower portion of the LD units 116-2 include LDs respectively. For example, the black light beam Bk is emitted from the upper LD and directed to the upper portion face of the polygon mirror 110, and the yellow light beam By emitted from the lower LD is directed to the lower portion face of the polygon mirror 110.

The black light beam Bk directed to the lower surface of the polygon mirror 110 is deflected as the polygon mirror 110 rotates. The deflected black light beam Bk passes through the scanning lens 111*a* and enters the reflection mirror 112*k*. Then, the black light beam Bk scans the photoconductor 120M as described with reference to FIG. 2.

The yellow light beam By directed to the lower portion face of the polygon mirror 110 is deflected as the polygon mirror 110 rotates. The deflected yellow light beam By passes through the scanning lens 111*a* and enters the reflection mirror 112*y*. Thereafter, the yellow light beam By scans on the photoconductor 120Y as described with reference to FIG. 2.

A synchronous mirror 118-2 and a synchronous sensor 119-2 are disposed in a non-image writing area, which is in an end portion on a writing start side in the main scanning direction, and outward a writing start position in the main scanning direction. The black and yellow light beams Bk a d By permeating through the scanning lens 111*a* are reflected by the synchronous mirror 118-2 and enters the synchronous sensor 119-2. The synchronous sensor 119-2 outputs synchronization detection signals for determining the timing of start of writing in the main scanning direction of respective colors as the black and yellow light beams enter the synchronous sensor 119-2.

Next, the configuration of the density sensor 70 will be described with reference to FIG. 4. FIG. 4 is a cross-sectional side view of the density sensor 70. The density sensor 70 is long in the main scanning direction. The density sensor 70 includes an image sensor that is long in the main scanning direction therein and sometimes called a line sensor. The detection width of the density sensor 70 in the main scanning direction indicated by the broken lines in the main scanning direction in FIG. 4. The detection width is longer than the width of the sheet P' in the main scanning direction. Accordingly, as the sheet P' is conveyed so as to pass through the width indicated by the broken lines in the main scanning direction, the image density can be detected over the entire area on the sheet P'.

Figure 5:
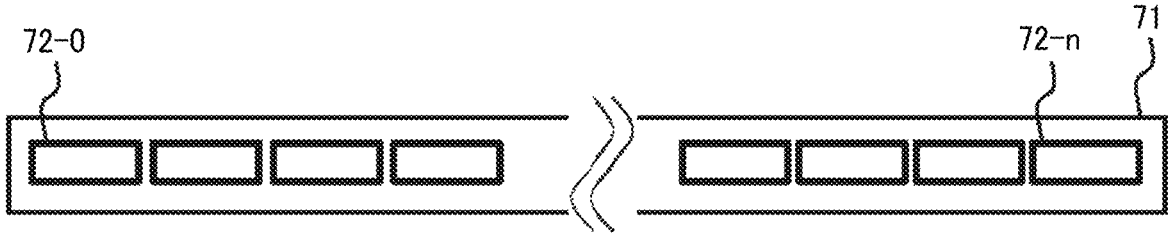
FIG. 5 is a schematic view of an image sensor of the density sensor illustrated in FIG. 4.

FIG. 5 is a schematic diagram of an image sensor 71 of the density sensor 70. As illustrated in FIG. 5, the image sensor 71 extends in the main scanning direction and includes small light-receiving elements 72-0 to 72-*n* (hereinafter collectively "light-receiving elements 72" when discrimination is not necessary) arranged side by side in the main scanning direction. The range in which the light-receiving elements 72 are arranged is the above-described detection width of the density sensor 70 in the main scanning direction.

Figure 6:
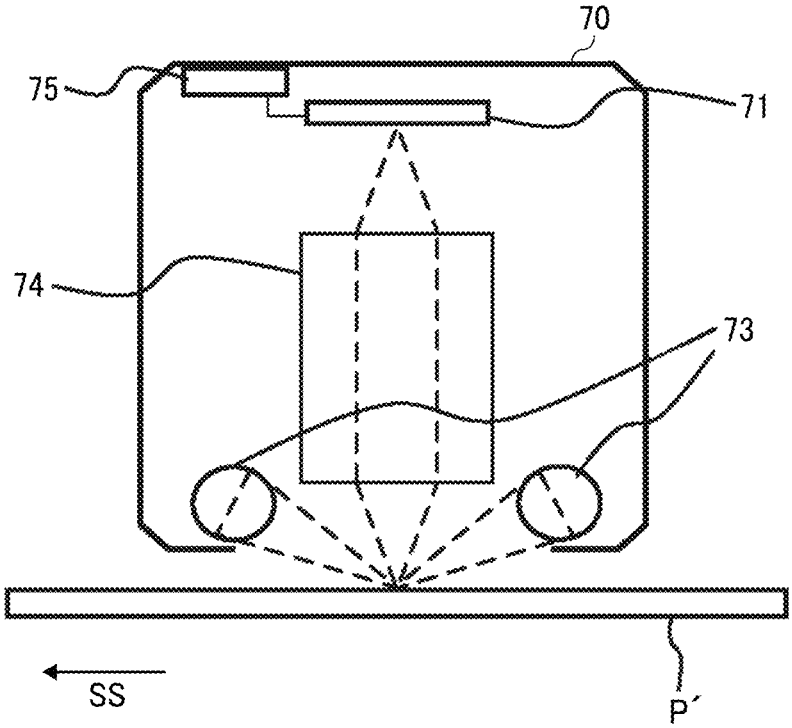
FIG. 6 is a cross-sectional view, perpendicular to a main scanning direction, of the density sensor illustrated in FIG. 4.

FIG. 6 is a cross-sectional view of the density sensor 70 perpendicular to the main scanning direction. As illustrated in FIG. 6, the density sensor 70 includes the above-described image sensor 71, light sources 73, a lens array 74, and an output circuit 75. The broken lines represent the light emitted from the light source 73.

As each of the light sources 73, for example, a light-emitting element disposed at an end of a light guide or and an LED array can be used. The light sources 73 emit light of red, green, and blue (RGB). The lens array 74 includes, e.g., a SELFOC® lens.

The light emitted from the light source 73 is reflected on the sheet P' and focused by the lens array 74. The image sensor 71 receives, with the light-receiving elements 72 illustrated in FIG. 5, the light focused by the lens array 74 and outputs a signal corresponding to the light received. That is, the positions of the light-receiving elements 72 serve as a plurality of detection positions. For example, a complementary metal oxide semiconductor (CMOS) sensor or a charge-coupled device (CCD) sensor is used as the image sensor 71.

For the output circuit 75, an application specific integrated circuit (ASIC) or the like is used. Based on the signal from each light-receiving element 72 on the image sensor 71, the output circuit 75 outputs data indicating the image density of the pattern corresponding to the position on the sheet P'. For example, the output circuit 75 outputs 0 to 255 gradations represented by 8 bits.

Figure 7:
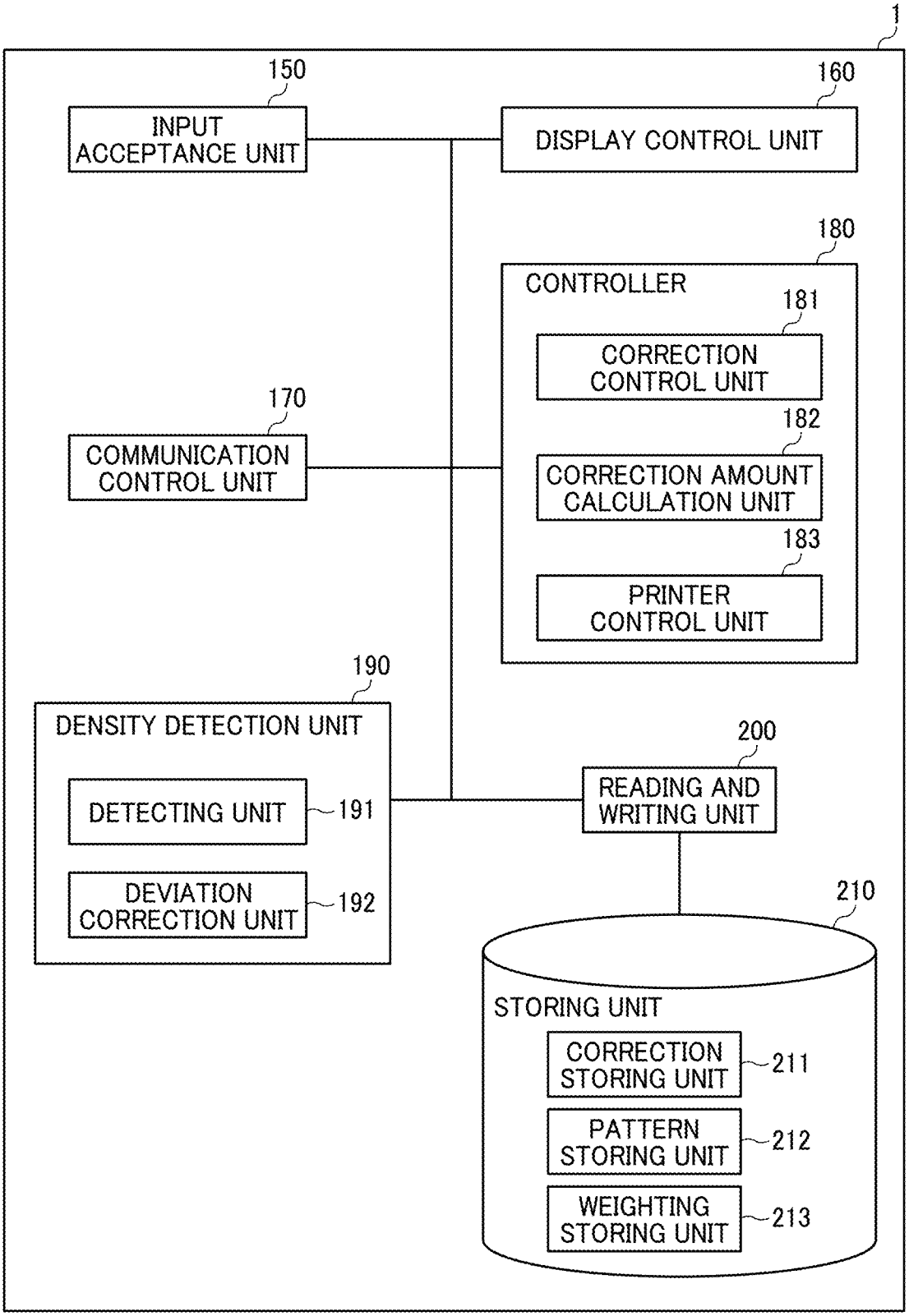
FIG. 7 is a functional block diagram of the image forming apparatus illustrated in FIG. 2.

FIG. 7 is a functional block diagram of the image forming apparatus 1. An input acceptance unit 150 is implemented by the control panel 60. The input acceptance unit 150 is configured to display information necessary for operation to the operator or user and accept various inputs made by the operator. The input acceptance unit 150 is also implemented by the processing of the external device I/F 50 and accepts a print instruction or setting change by a user, input from an external device via a LAN or the Internet.

The display control unit 160 is implemented by the CPU 10 executing a program stored in the ROM 20 or HDD 40, using the RAM 30 as a work area. The display control unit controls a display screen to be displayed on the input acceptance unit 150.

The communication control unit 170 is implemented by the processing of the external device I/F 50. To transmit via email the image data to the outside or accept various types of setting information from an external device, the communication control unit 170 communicates with the external device via a network.

The controller 180 is implemented by the CPU 10 executing a program stored in the ROM 20 or the HDD 40 using the RAM 30 as a work area, and executes copying, scanning, printing, or a facsimile function, as one example of the function of the entire image forming apparatus 1.

The controller 180 includes a correction control unit 181, a correction amount calculation unit, and a printer control unit 183. The correction control unit 181 controls correction of uneven density in the printer function. The correction amount calculation unit 182 calculates the amount by which the image forming condition is to be corrected (correction amount), for correcting the uneven density. The printer control unit 183 controls, in particular, the printer engine 100. Details of the correction control unit 181, the correction amount calculation unit 182, and the printer control unit 183 will be described later.

A density detection unit 190, implemented by the density sensor 70, detects the density of the image pattern formed by the printer engine 100 and outputs the detection result.

The density detection unit 190 includes a detecting unit 191 and a deviation correction unit 192. The detecting unit 191, implemented by the image sensor 71, executes detection of a signal indicating the image density. The deviation correction unit 192 is executed by the output circuit 75. The deviation correction unit 192 detects positional deviation of the sheet being conveyed, from the signal indicating the image density, and outputs data in which the deviation is corrected as a detection result.

A reading and writing unit 200 is implemented by the CPU 10 executing a program stored in the ROM 20 or the HDD 40 using the RAM 30 as a work area. The reading and writing unit 200 stores various types of data in a storing unit 210 and retrieves the data stored therein.

The storing unit 210 is implemented by execution of a program stored in the ROM 20 or the HDD 40 to store programs, document data, various image forming conditions and various setting information necessary for the operation of the image forming apparatus 1, and operation logs of the image forming apparatus 1. Examples of image forming conditions include a charging bias, a developing bias, the intensity of optical writing light, and a transfer bias.

Various information stored in the storing unit 210 can be set before shipment of the image forming apparatus 1 or can be updated after sales. The storing unit 210 can be implemented by the temporary storage function of the RAM 30 depending on the stored information.

The storing unit 210 includes a correction storing unit 211, a pattern storing unit 212, and a weighting storing unit 213. The correction storing unit 211 stores correction contents of various image forming conditions. The pattern storing unit 212 stores various image patterns such as correction patterns. The weighting storing unit 213 stores weighting used for calculating a correction amount of image forming condition for correcting uneven density described later.

Figure 8:
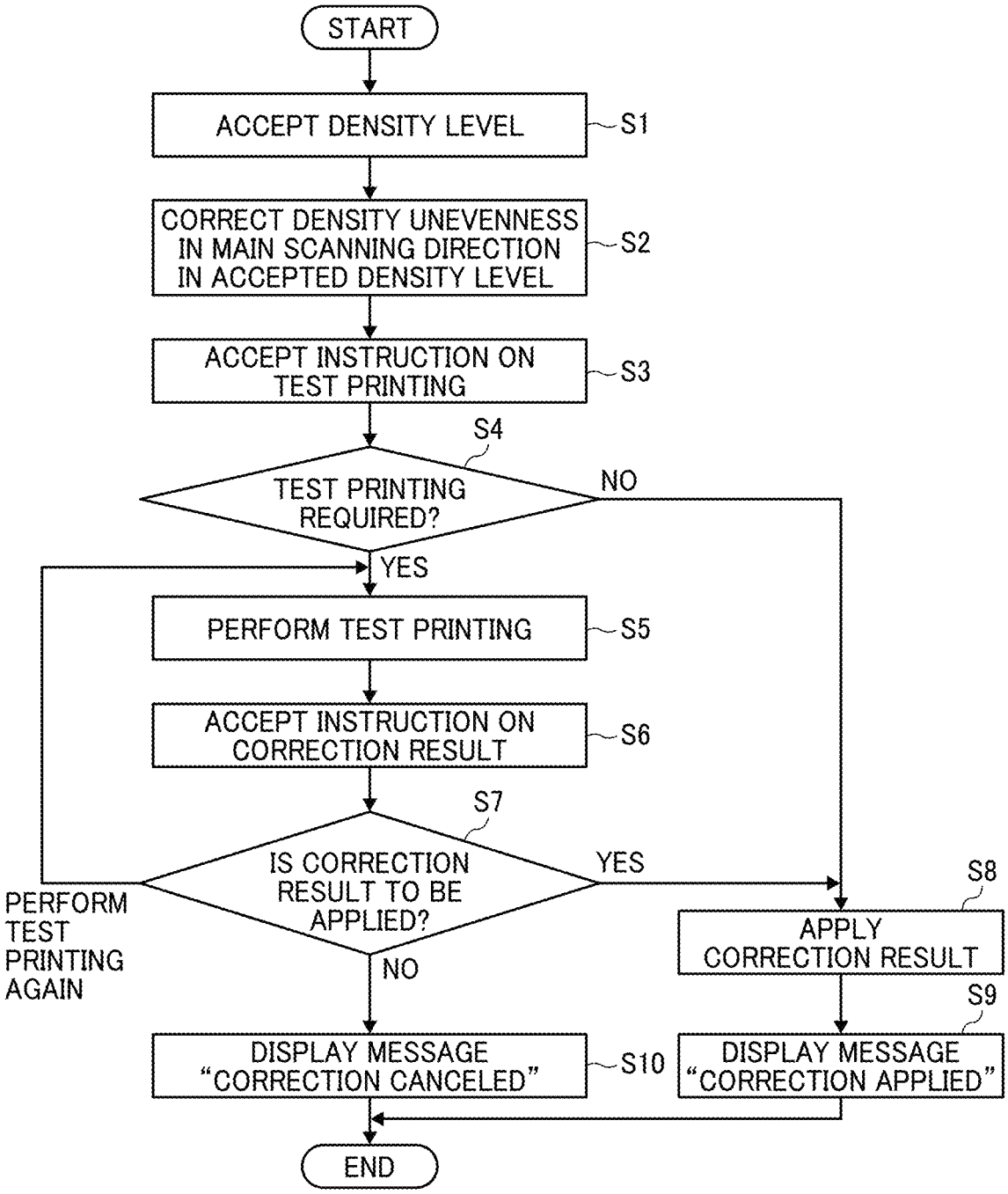
FIG. 8 is a flowchart of correction of uneven density according to an embodiment.

FIG. 8 is a flowchart of correction of uneven density executed by the image forming apparatus 1.

In S1, the input acceptance unit 150 accepts a density level designated by the user. The user inputs, to the control panel 60, the density level subjected to correction of uneven density. Then, the controller 180 corrects uneven density in the main scanning direction with respect to the accepted density level (S2). In the correction of uneven density, at least a part of the image forming conditions is corrected so as to suppress the uneven density.

As described above, in the present embodiment, correction of uneven density is performed regarding the density level input by the user. Such correction attains the image quality that better meets the user's requirement.

Next, the input acceptance unit 150 accepts, from the user, an instruction on whether or not to perform test printing (S3). Test printing is performed to allow the user to ascertain the effect of correction of uneven density. The user can check, with eyes, the image on the sheet P' output as the result of the test printing to ascertain whether or not the desired image is obtained.

When the input from the user is "unnecessary" for test printing (S4), the controller 180 applies the correction result (S8). One example of the correction result is a corrected image forming condition, and another example is a correction amount to be added to the image forming condition at the time of image formation. One example of applying the correction result is storing the correction result in the correction storing unit 211. Preferably, the storing at this time is not made in a temporary storage medium but in a non-volatile storage medium such as the HDD 40 so that the data is not erased even if the power of the image forming apparatus 1 is turned off. When stored in such a manner, the correction result can be read out at the next image formation, and image formation can be performed under the corrected image forming condition.

After applying the correction result in S8, the display control unit 160 displays, on the control panel 60, a message indicating that the correction is applied or correction of uneven density is completed, for example (S9).

Returning to S4, in response to the input from the user of "necessary" regarding test printing (Yes in S4), the controller 180 executes test printing under the image forming condition corrected according to the result of correction of uneven density (S5).

In S6, the input acceptance unit 150 receives an input from the user of whether or not to apply the correction result (S6), as a result of the confirmation on the test printing.

When the input of the user is "apply", the controller 180 applies the correction result (S8), after which the display control unit 160 displays, on the control panel 60, a message indicating that the correction is applied or completed (S9).

When the input of the user is "not apply" (or cancel), the display control unit 160 displays a message that correction is canceled or a message that correction of uneven density is completed without applying the correction result, on the control panel 60 (S10). Then, the correction of uneven density ends.

In response to an input of "perform test printing again" from the user at S7, the process returns S5 to perform test printing.

Descriptions are given of the correction of uneven density. It is possible that image density specified by the image data is not attained and the image includes unevenness not desired by the user, due to variations in the shape and properties of components of the image forming apparatus 1, changes with time, changes in the environment where the image forming apparatus 1 is installed, and the like. As an approach to correct the uneven density, for example, a density unevenness correction pattern, which is an image pattern with image density constant in the main scanning direction, is formed on a sheet or an intermediate transfer belt, the image density of the pattern is read, and various image forming conditions are corrected.

However, desiring high image quality, some users further desire to eliminate uneven density at a specific density level. Depending on the cause of uneven density, the density tends to become uneven at a specific density level in some cases. Therefore, in the present embodiment, correction of uneven density is performed with respect to the density level accepted from the user.

Descriptions are given below of one example where, as the image forming condition, the LD power (the exposure power of the writing light by the exposure device 101) is corrected. In this case, for example, an image is formed with the density set constant in the main scanning direction, the density of the image is detected, and the intensity of the LD power of the writing light at the writing position corresponding to the position of the uneven density is corrected to eliminate the detected uneven density.

Figure 9:
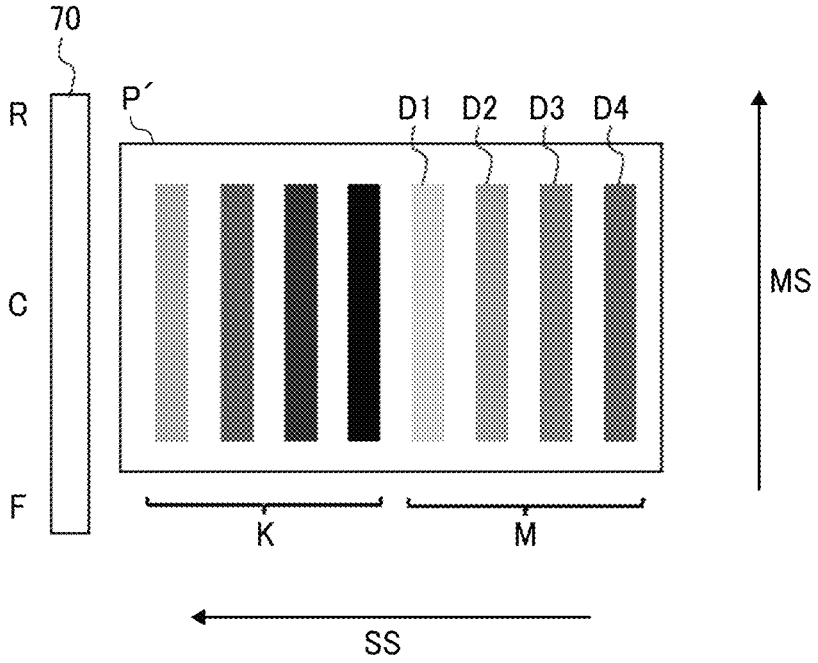
FIG. 9 is an example of a pattern for correction of uneven density according to an embodiment.

FIG. 9 illustrates an example density unevenness correction pattern. Hereinafter, the density unevenness correction pattern may be referred to as a correction pattern. In FIG. 9, reference characters R, C, and F respectively indicate a rear side, a center side, and a front side as depth positions in the main scanning direction of the image forming apparatus 1. The front side is the side on which, for example, the user operates the control panel 60 and the like. The reference characters R, C, and F are also used in the subsequent descriptions and subsequent figures.

FIG. 9 illustrates a state in which the sheet P' on which the correction patterns is formed is being conveyed toward the density sensor 70 in the sheet conveyance direction indicated by arrow SS. The sheet P' bears four black correction patterns of different density levels and four magenta correction patterns of different density levels. Density references D1 to D4 are given, from the lower density side, to the correction patterns of different densities. In each of the correction patterns, the density is uniform.

As illustrated in FIG. 9, the image forming apparatus 1 of the present embodiment creates a plurality of correction patterns of different densities D1 to D4 for each color and calculates the correction amount of the LD power based on the image density detected for each correction pattern, to reduce the uneven image density (image unevenness). Since the correction amounts are calculated based on the detection results of the correction patterns of the respective density levels, correction amounts corresponding to different density levels can be obtained. Therefore, the user can correct uneven density for the density level selected from, at least, the plurality of density levels corresponding to the number of correction patterns formed.

Figure 10:
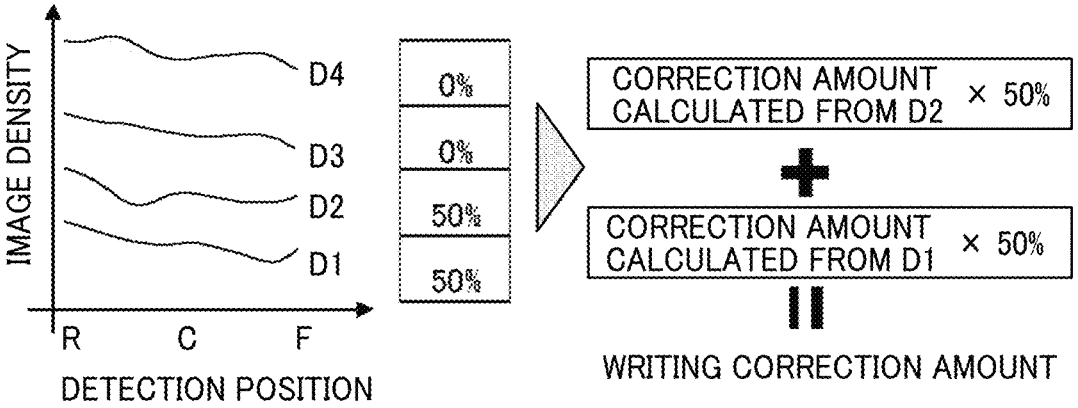
FIG. 10 is a diagram illustrating weighting in correction of uneven density according to an embodiment.

FIG. 10 is a diagram illustrating weighting in correction of uneven density. The variation of density levels selectable by the user can be increased by performing weighting in the calculation of the correction amount as described below.

The graphs illustrated on the left in FIG. 10 are the densities of the magenta correction patterns having densities D1 to D4 in FIG. 9 detected by the density sensor 70. The correction of uneven density is performed based on the detected image densities of a plurality of correction patterns (toner images) having different densities.

The correction amount at an optical writing position x is expressed by the following Expression 1 and Expression 2 for example.

$$M(x)=M1(x)\times\alpha1+M2(x)\times\alpha2+M3(x)\times\alpha3+M4(x)\times\alpha4 \quad \text{Expression 1}$$

$$\alpha1+\alpha2+\alpha3+\alpha4=1 \quad \text{Expression 2}$$

where M1 represents a correction amount based on the uneven density of the correction pattern of the density D1, M2 represents a correction amount based on the uneven density of the correction pattern of the density D2, M3 represents a correction amount based on the uneven density of the correction pattern of the density D3, and M4 represents a correction amount based on the uneven density of the correction pattern of the density D4.

As one example, to correct the uneven density for the density level between the densities D1 and D2, the individual correction amount calculated for each of the densities D1 to D4 is multiplied by weighting, and the sum of the multiplied values is used as a weighted correction amount for magenta of that density level. One example of the weighting is illustrated at the center in FIG. 10, in which the weighting for the density D1 is 50%, the weighting for the density D2 is 50%, the weighting for the density D3 is 0%, and the weighting for the density D4 is 0%. The weightings for the densities D3 and D4 are 0%. Accordingly, according to the expressions presented on the right in FIG. 10, 50% of the correction amount calculated from the density D1 and 50% of the correction amount calculated from the density D2 are summed up as the writing correction amount.

That is, as a result of such correction, the correction amount of the magenta writing light is expressed by Expression 3.

$$M(x)=0.5\times M1(x)+0.5\times M2(x) \quad \text{Expression 3}$$

Figure 11A:
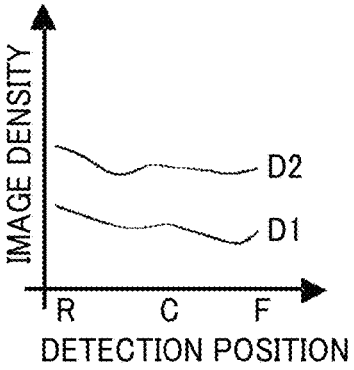
FIG. 11A is a conceptual diagram illustrating an image density distribution contributing to calculation of a correction amount in the main scanning direction according to an embodiment.

FIG. 11A is a conceptual diagram illustrating image density distribution contributing to the calculation of the correction amount when the above-described weighting is performed. Of the detected image density distribution unevenness at the densities D1 to D4, the image densities D1 and D2 contribute to calculation of the correction amount.

Figure 11B:
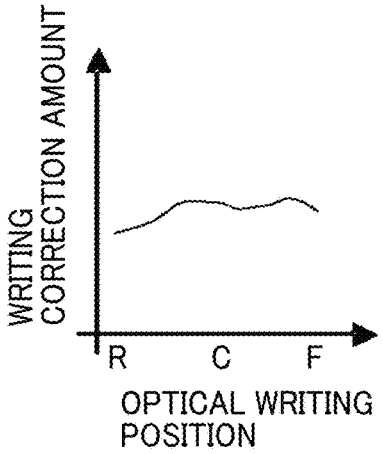
FIG. 11B is a conceptual diagram illustrating a writing correction amount obtained as a result of the weighting illustrated in FIG. 10.
Figure 11C:
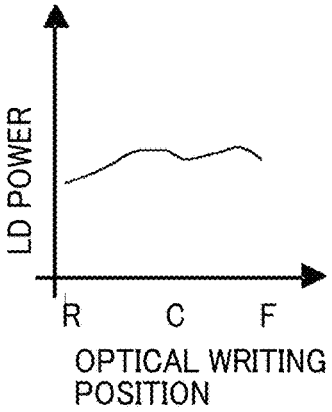
FIG. 11C is a conceptual diagram illustrating a laser diode power obtained as a result of the weighting illustrated in FIG. 10.

FIG. 11B is a conceptual diagram illustrating the writing correction amount obtained as a result of the above weighting. FIG. 11C is a conceptual diagram illustrating the LD power obtained as a result of the above weighting. When the weighted correction amount illustrated in FIG. 11B, which is calculated after weighting, is added as the correction amount to the LD power at the time of forming the correction pattern, the uneven density of the density level between the densities D1 and D2 can be corrected. Therefore, the user can select the density level for correcting the uneven density, from a greater number of density levels than the four density levels for which the correction pattern has been formed.

As another example of the density level for performing the correction of uneven density, when the user selects the level of the density D1, the weighting of the density D1 is set to 100%, and the weightings of each of the densities D2, D3, and D4 is set to 0%. Thus, a table of the weighting as illustrated in FIG. 10 is determined for each density level selectable by the user, and the table is stored in advance in the weighting storing unit 213.

Correction for the four black correction patterns in FIG. 9 can be performed similar to the correction for magenta. For cyan and yellow, correction patterns are similarly formed on a second sheet in the same way, and correction is performed for all the colors in the same way. Although the correction amount with respect to the LD power is explained as one example, alternatively, a correction amount for the degree of pulse width modulation can be calculated. Further, the manner of correction described above can adapt to a configuration using LED light as the writing light.

In this manner, the respective correction amounts for correcting the uneven image densities are calculated from the plurality of density unevenness correction patterns having different densities, and weighting is made for each correction amount to calculate the correction amount. Such correction operation is advantageous in increasing the number of density levels selectable from the number of density levels regarding which the respective correction patterns have been formed.

Figure 12:
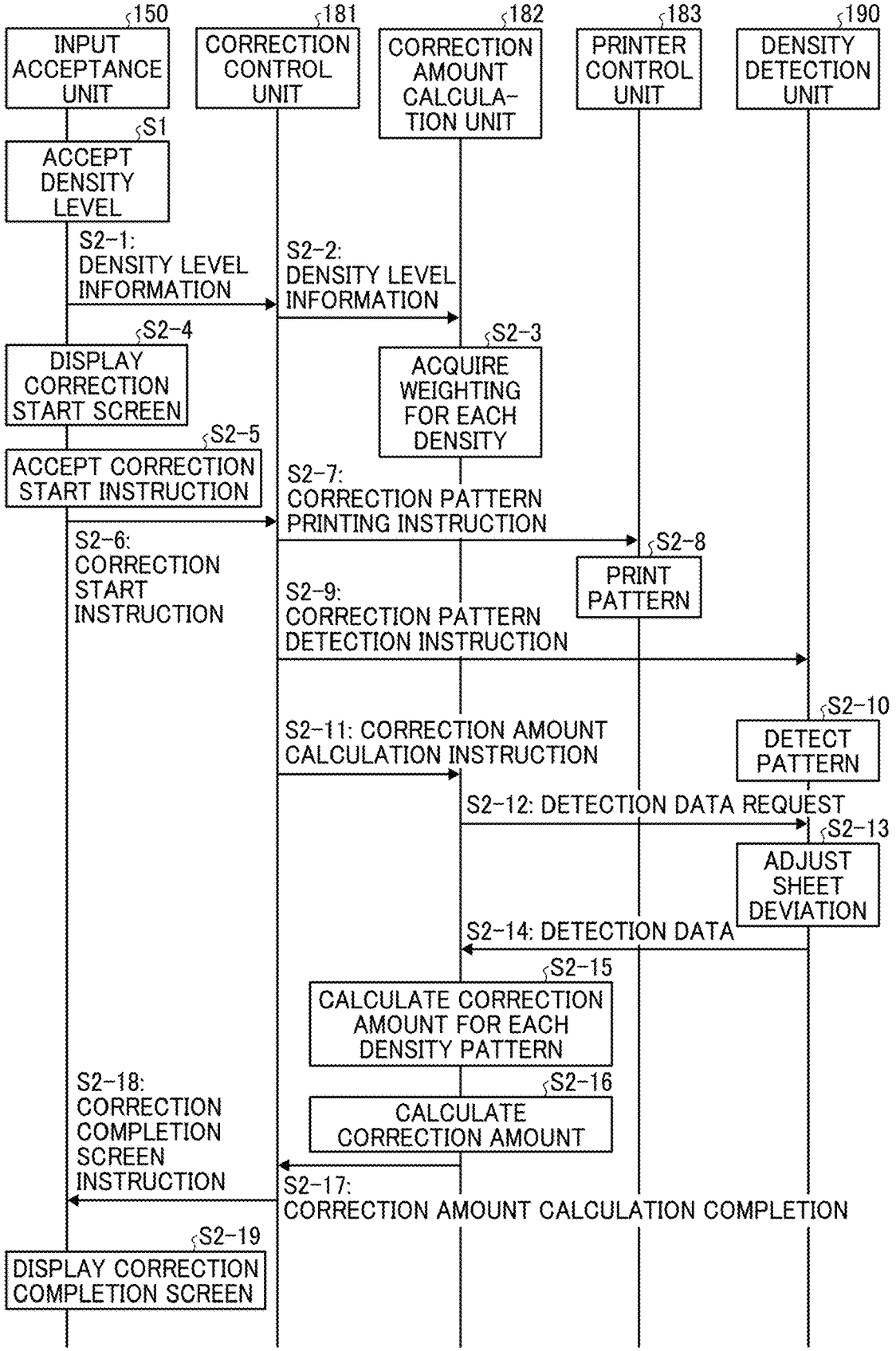
FIG. 12 is a sequence chart of correction of uneven density illustrated in FIG. 8.

FIG. 12 is a sequence chart of correction of uneven density. Operations in S1 to S2 in FIG. 8 will be described in detail with reference to FIG. 12.

Figure 13:
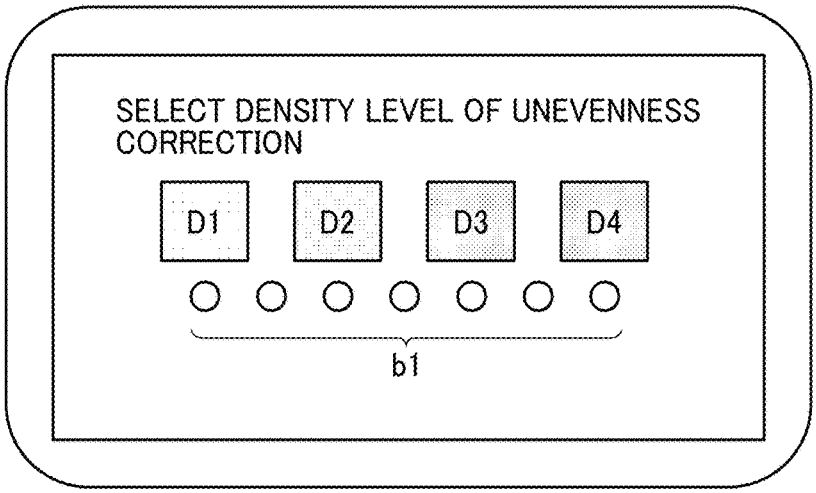
FIG. 13 is an example screen on which a user selects a density level of correction of uneven density, according to an embodiment.

In S1, the input acceptance unit 150 accepts the density level input by the user. The user inputs the density level subjected to correction of uneven density. FIG. 13 illustrates an example of a screen displayed to the user at this time.

FIG. 13 illustrates an example of a screen on which the user selects the density level for the correction of uneven density. The control panel 60 indicates that the image forming apparatus 1 is in the mode for selecting the density level of unevenness correction. Further, the control panel 60 presents, to the user, respective examples of the densities D1 to D4 to assist the selecting of the density level.

On the control panel 60 illustrated in FIG. 13, a group b1 including a plurality of selection buttons are presented for the user. The user selects a selection button close to the density for which the user desires to correct the uneven density, from the plurality of selection buttons.

As the input acceptance unit 150 accepts the density level information input by the user on the screen illustrated in FIG. 13, the controller 180 starts the correction of uneven density in S2 in FIG. 8.

In response to acceptance of the density level information from the user (S1), in S2-1 in FIG. 12, the input acceptance unit 150 outputs the input density level information to the correction control unit 181. In S2-2, the correction control unit 181 further outputs the density level information to the correction amount calculation unit 182.

The correction amount calculation unit 182 acquires the weighting for each density level, corresponding to the accepted density level, from the weighting storing unit 213 (S2-3).

On the selection screen illustrated in FIG. 13, when the user selects a different density level, operations in S2-1 to S2-3 are repeated.

Further, when the input acceptance unit 150 accepts the density level subjected to correction of uneven density input by the user (S1), the input acceptance unit 150 displays a correction start screen (S2-4). Note that the operation in S S2-1 to S2-3 and the operation in S2-4 can be performed in parallel.

Figure 14:
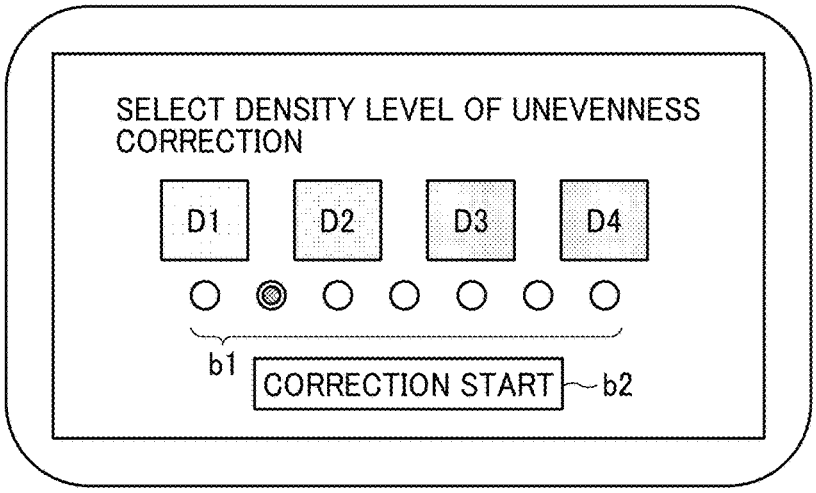
FIG. 14 is an example screen on which the user inputs start of correction of uneven density.

FIG. 14 illustrates an example screen on which the user instructs the start of the correction. As one example, the screen in FIG. 13 is in the case where the user selects the density level between the density D1 and the density D2. As illustrated in FIG. 14, when the user selects the density level, a correction start button b2 is displayed.

Referring back to FIG. 12, as the user presses the correction start button b2 on the screen illustrated in FIG. 14, the input acceptance unit 150 accepts the correction start instruction (S2-5). Then, the input acceptance unit 150 outputs the correction start instruction to the correction control unit 181 (S2-6). The correction control unit 181 acquires the correction patterns from the pattern storing unit 212 and instructs the printer control unit 183 to form images according to the acquired correction patterns (S2-7).

The printer control unit 183 instructs the printer engine 100 to print the instructed correction patterns on the sheet (S2-8). The correction control unit 181 further instructs the density detection unit 190 to detect the image densities of the correction patterns printed, under control of the printer control unit 183 (S2-9). The density detection unit 190 executes image density detection of the correction patterns (S2-10).

In S2-11, the correction control unit 181 instructs the correction amount calculation unit 182 to calculate the correction amount. The correction amount calculation unit 182 requests the density detection unit 190 to provide the image density detection data (S2-12). The density detection unit 190 adjusts deviation of the sheet with respect to the image density detection data (S2-13) and transmits the result as detection data to the correction amount calculation unit 182 (S2-14). A detailed description is given later of the correction of sheet deviation.

Based on the detection data, the correction amount calculation unit 182 calculates the correction amount for each of the correction patterns having different densities (S2-15). The correction amount calculation unit 182 calculates the weighted correction amount corresponding to the density level information based on each correction amount and the weighting acquired in S2-3 (S2-16).

The correction amount calculation unit 182 notifies the correction control unit 181 of the completion of the correction amount calculation (S2-17). The correction control unit 181 instructs the input acceptance unit 150 to provide a correction completion screen via the display control unit 160 (S2-18). In response to a reception of the instruction, the input acceptance unit 150 displays the correction completion screen (S2-19).

Figure 15:
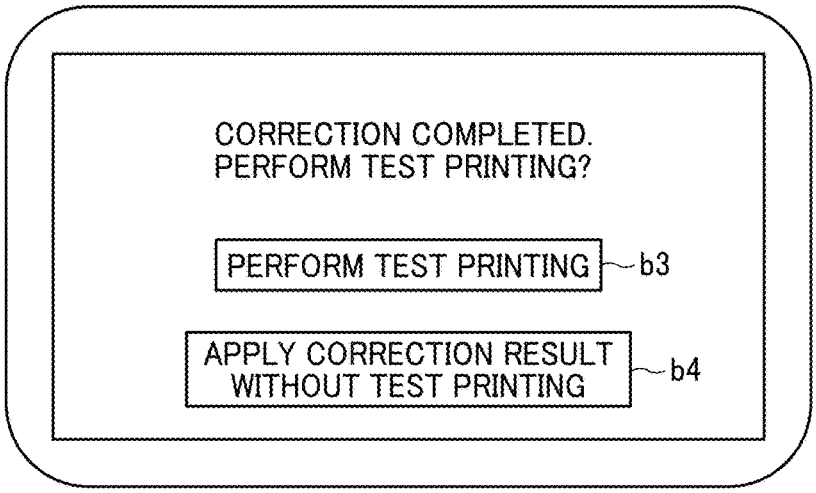
FIG. 15 illustrates an example correction completion screen according to an embodiment.

FIG. 15 illustrates an example of the correction completion screen on the control panel 60, on which a message "Correction completed" to the user is displayed. Further displayed thereon is a message "Perform test printing?" inquiring whether or not to perform test printing. The user can press either a button b3 or b4 to input, to the image forming apparatus 1, whether to perform test printing. Therefore, the screen illustrated in FIG. 15 also functions as a test printing confirmation screen.

Figure 16:
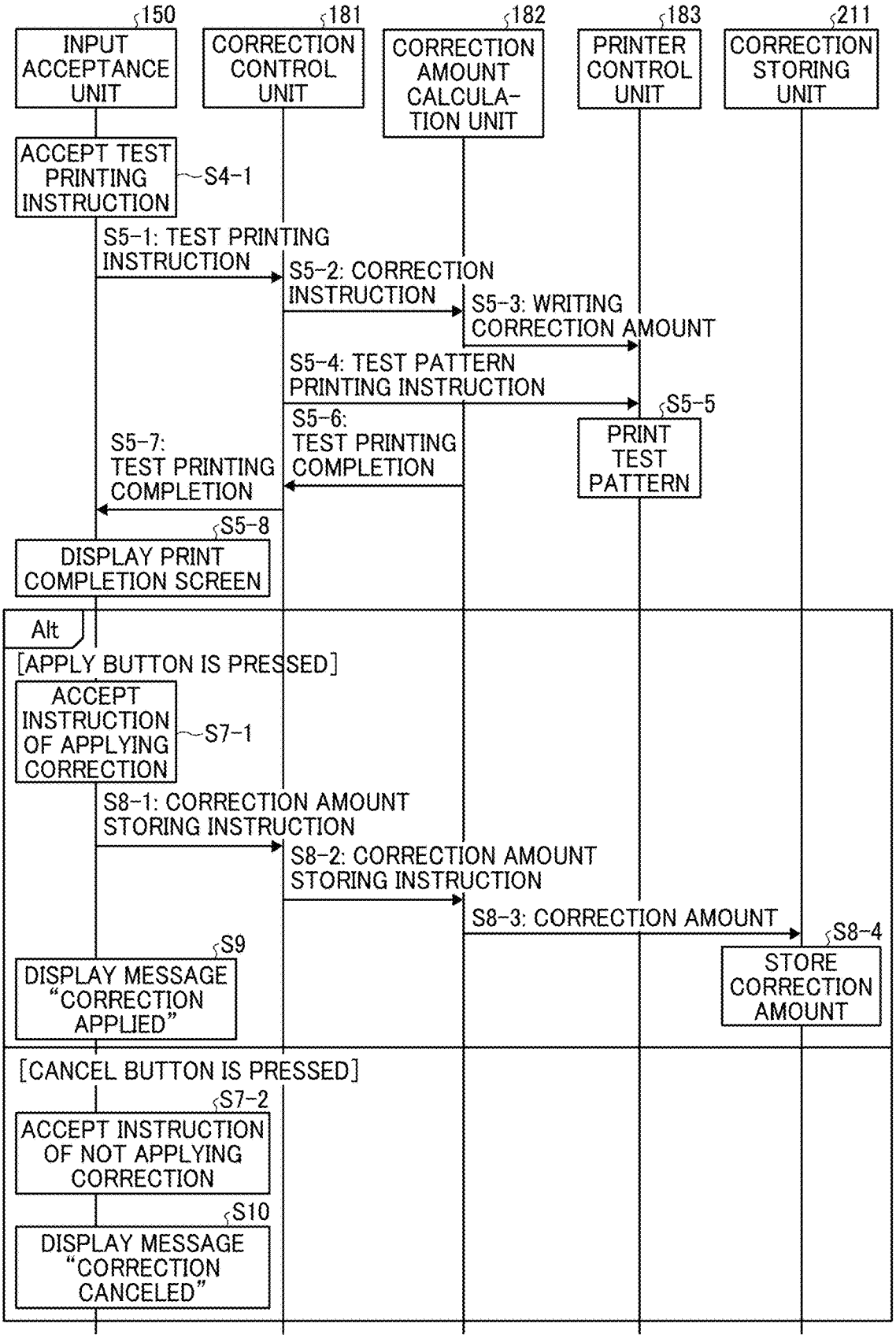
FIG. 16 is a sequence chart of applying the correction illustrated in FIG. 8.

FIG. 16 is a sequence chart of process of applying the correction. With reference to FIG. 16, descriptions are given below of details of S4 to S10 in the case where the correction is applied in S7 of the flowchart illustrated in FIG. 8 and in the case where the correction is not applied.

First, in the screen example illustrated in FIG. 15, as the user selects the button b3, the input acceptance unit 150 accepts a test printing instruction (S4-1). The input acceptance unit 150 instructs the correction control unit 181 on the test printing (S5-1). In response to a reception of the instruction, the correction control unit 181 transmits an instruction on the correction to the correction amount calculation unit 182 (S5-2).

In response to a reception of the instruction, the correction amount calculation unit 182 transmits the writing correction amount to the printer control unit 183 (S5-3). Further, the correction amount calculation unit 182 acquires the test pattern from the pattern storing unit 212 and instructs the printer control unit 183 to perform printing with the corrected writing correction amount (S5-4). The test pattern can be the same as or different from the correction pattern.

The printer control unit 183 prints the test pattern (S5-5). In response to completion of the test printing, the correction amount calculation unit 182 notifies the correction control unit 181 of the completion of the test printing (S5-6). In response to a reception of the notification, the correction control unit 181 causes the display control unit 160 to instruct the input acceptance unit 150 to display the print completion screen (S5-8). Alternatively, the notification of completion of the test printing at S5-6 can be executed in response to the completion of the printing instruction at S5-4, without waiting for completion of image formation on the sheet.

Figure 17:
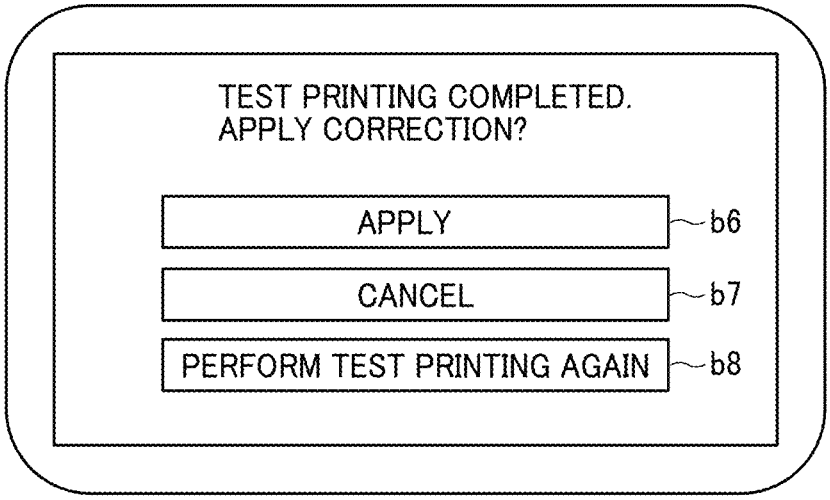
FIG. 17 illustrates an example test printing completion screen.

FIG. 17 illustrates an example test printing completion screen on the control panel 60. The test printing completion screen includes a message "Test printing completed" to the user and a message "Apply correction?" inquiring the user whether or not to apply the correction.

The user can check the image quality of the test printing. When the image quality is satisfactory, the user can press a button b6 to apply the correction. When the image quality is not satisfactory, the user can press a button b7 to cancel the correction. Further, to conduct test printing again, the user presses a button b8 to return to the operation in S5 in FIG. 8. Therefore, the screen illustrated in FIG. 17 also functions as a correction applying determination screen.

Descriptions with reference to FIG. 16 continue. As the user presses the button b6 in FIG. 17 at S7-1, the input acceptance unit 150 instructs the correction control unit 181 to store the correction amount (S8-1). The correction control unit 181 instructs the correction amount calculation unit 182 to store the correction amount (S8-2). The correction amount calculation unit 182 transmits the correction amount to the correction storing unit 211 (S8-3), and the correction storing unit 211 stores the correction amount (S8-4).

The input acceptance unit 150 displays a message indicating that applying the correction is completed on the control panel 60 (S9), and the operation of the controller 180 ends.

On the other hand, when the user presses the button b7 (S7-2), the input acceptance unit 150 displays, on the control panel 60, a message indicating that the correction of uneven density is to be canceled (S10), and the operation of the controller 180 ends.

Next, details of the correction of sheet deviation in S2-13 in FIG. 12 will be described. First, sheet deviation will be described with reference to FIGS. 18A and 18B.

In FIGS. 18A and 18B, the sheet P' is conveyed to the image sensor 71 of the density sensor 70, as indicated by an arrow. In FIGS. 18A and 18B, only the portion of the sheet P' where the correction pattern having the density D4 is formed is illustrated.

As described above, the plurality of light-receiving elements 72 are arranged in the image sensor 71. In (a) and (b) of FIG. 18, 64 light-receiving elements 72-0 to 72-63 are lined in the main scanning direction from the left in the drawing. In (a) and (b) of FIG. 18, only the light-receiving elements 72-0 and 72-63 are denoted by reference numerals, but numbers 0 to 63 are added in the light-receiving elements 72 including the light-receiving elements 72-0 and 72-63 for distinguishing the light-receiving elements 72. The same applies to the following drawings.

Figure 18:
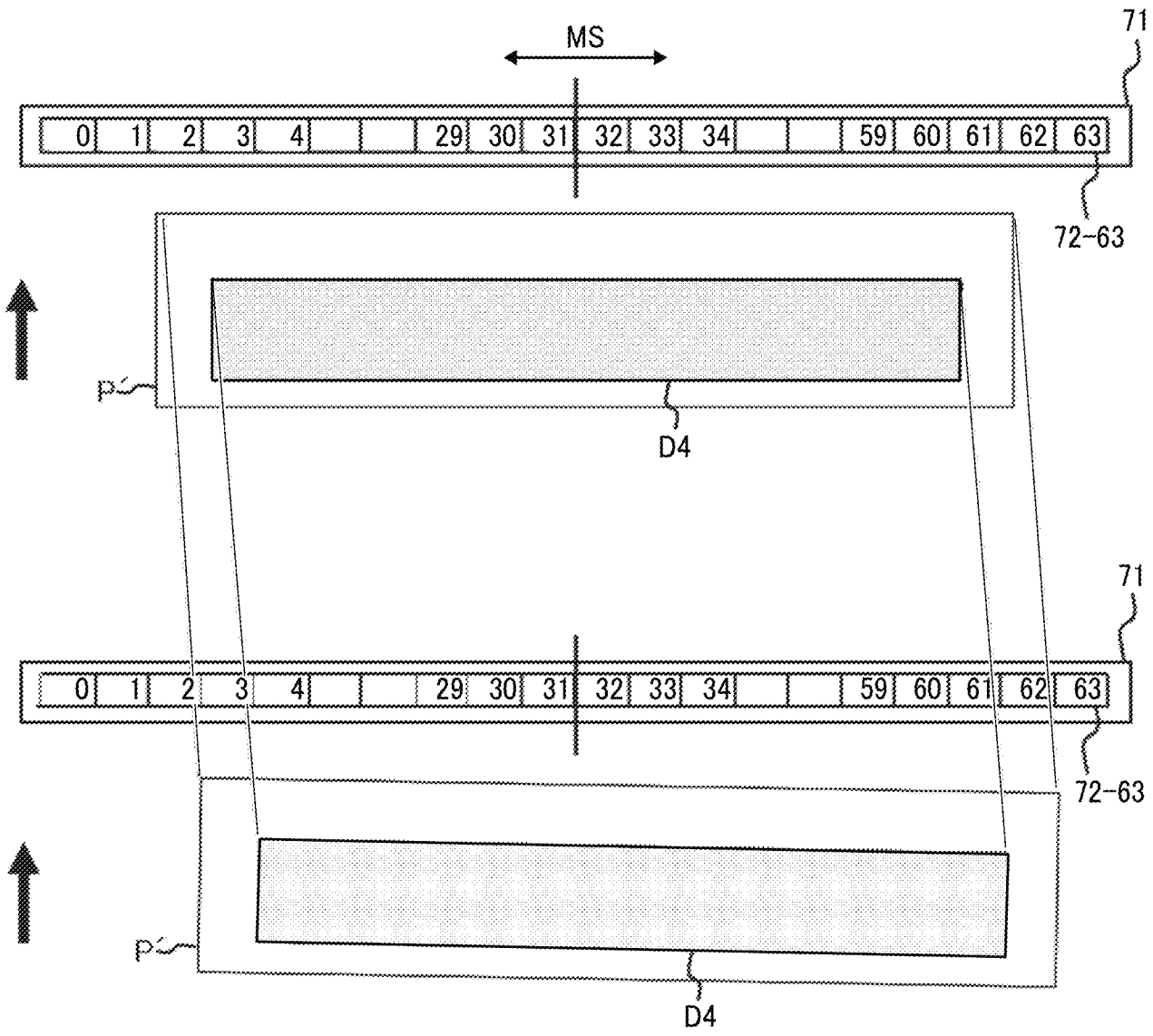
FIG. 18 is a conceptual diagram of deviation of a sheet.

FIG. 18 (*a*) illustrates a state where there is no sheet deviation. Ideally, as illustrated in FIG. 18 (*a*), a center position of the correction pattern in the main scanning direction (indicated by arrow MS) matches a position (indicated by the bold line) between the light-receiving element 72-31 and the light-receiving element 72-32 in the drawing. In this case, in other words, the center position of the correction pattern matches the center position in the detection width of the density sensor 70 in the main scanning direction.

However, the sheet P' may deviate in the main scanning direction while conveyed from the secondary transfer position Tr to the density sensor 70. As one example, FIG. 18 (*b*) illustrates a state in which the sheet P' deviates toward the right side on the drawing, that is, to the side where the subscript of the reference numeral of the light-receiving element 72 is greater.

In the ideal state illustrated in FIG. 18 (*a*), the right end of the correction pattern passes between the light-receiving elements 72-60 and 72-61. However, due to the deviation of the sheet P', the right end of the correction pattern passes between the light-receiving elements 72-61 and 72-62 in FIG. 18 (*b*).

In the image forming apparatus 1 designed to convey the sheet P' as illustrated in FIG. 18 (*a*), when the image density is detected in the state illustrated in FIG. 18 (*b*) due to the sheet deviation, there arises a deviation between the position of image formation (e.g., position of optical writing) and the position at which the density sensor 70 detects the image density in the main scanning direction.

Figure 19A:
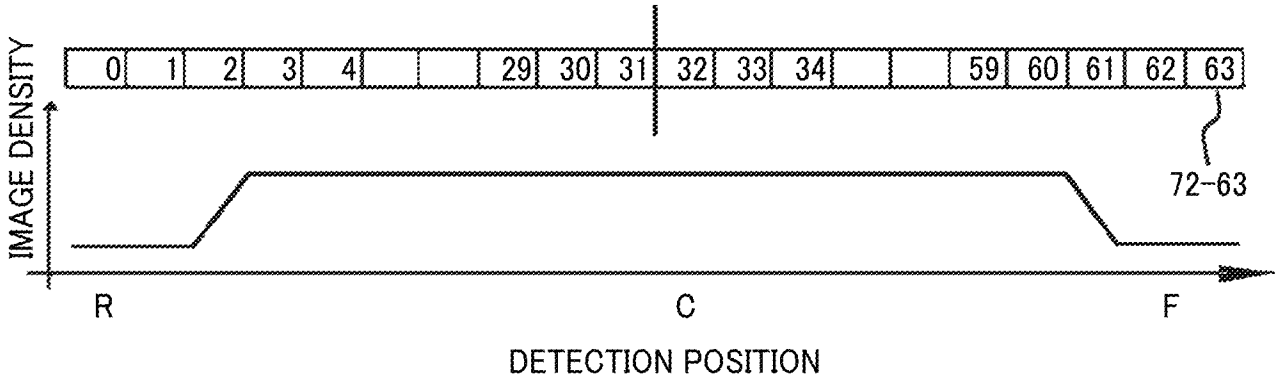
FIGS. 19A and 19B are graphs illustrating example results of detection of image density in a case where the deviation of the sheet occurs.
Figure 19B:
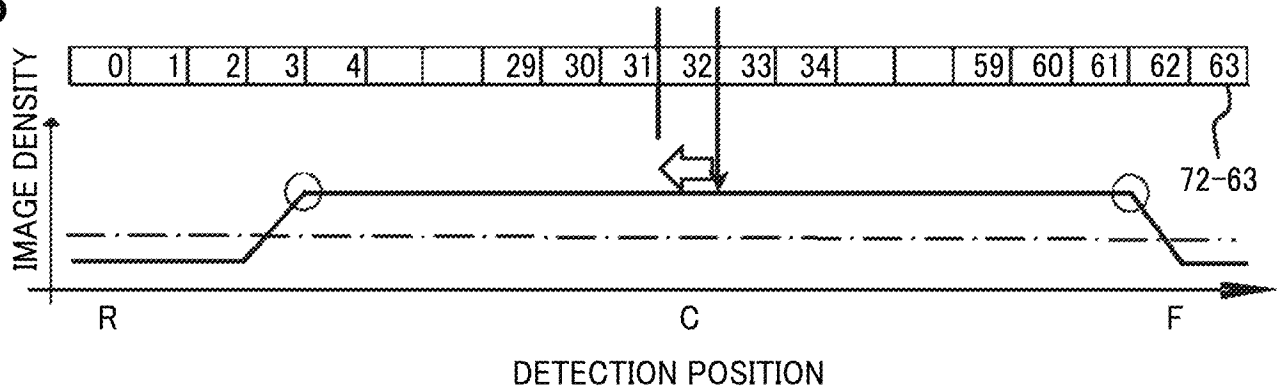

FIG. 19A is a graph illustrating the result of image density detection in the case where a sheet deviation occurs. FIGS. 19A and 19B illustrate the image densities detected by the density sensor 70 in the case illustrated in (a) and (b) of FIG. 18, respectively. FIGS. 19A and 19B are on the assumption that uneven density of such a degree that appears in the detection result of image density does not occur in the correction pattern having the density D4.

As described with reference to (a) and (b) of FIG. 18, the detection result illustrated in FIG. 19B illustrates the result of detection performed at a position deviated from the image formation position in the main scanning direction. That is, in the state where the sheet P' is not deviated, the light-receiving elements 72-2 to 72-61 detect the image density corresponding to the correction pattern of density D4 as illustrated in FIG. 19A. By contrast, in the state illustrated in FIG. 19B, the light-receiving elements 72-3 to 72-62 detect the image density corresponding to the correction pattern of density D4. Therefore, the correction of uneven density is not properly performed if the correction is performed based on FIG. 19B, which is the result of detection on the deviated sheet P'.

Therefore, the density detection unit 190 determines whether the sheet P' is deviated (in the position in the main scanning direction). When the sheet P' is deviated, the density detection unit 190 adjusts the position of detection of image density in the main scanning direction, and outputs the adjusted detection result (detected image density).

Figure 20:
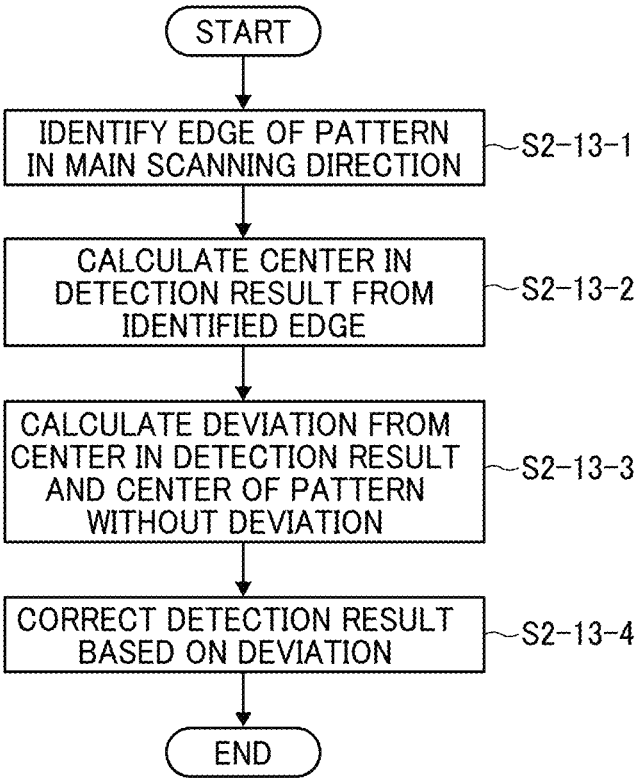
FIG. 20 is a flowchart of correction of deviation of the sheet, according to an embodiment.

FIG. 20 is a flowchart of the correction of sheet deviation. The density detection unit 190 grasps, as a detection result under no sheet deviation, characteristic of result of detection of the correction pattern obtained when the sheet P' is not deviated. In the flowchart illustrated in FIG. 20, the density detection unit 190 compares the detection result under no sheet deviation with the actual detection result, to determine the degree of sheet deviation, and corrects the detection result based on the degree of sheet deviation.

First, the deviation correction unit 192 calculates the image density at the position of each light-receiving element 72 based on the signal from the detecting unit 191 and locates an edge of the correction pattern D4 in the main scanning direction based on the calculated image density (S2-13-1).

Specifically, for example, when the image density is a gradation of 0 to 255, the deviation correction unit 192 sets a value that would appear, with a high possibility, at the edge of the correction pattern to 100 (indicated by one-dot chain line in FIG. 19B) as an edge determination threshold and stores the edge determination threshold preliminarily in the storing unit 210, for example. In the detection result, the deviation correction unit 192 determines, as edges of the correction pattern, two transition positions in the main scanning direction (indicated by circles in the figure) at which the detected density rises exceeding the edge determination threshold.

Next, the deviation correction unit 192 identifies a detection result center position that is the center position in the detection result calculated from the determined edge position in the detection result (S2-13-2). In the case illustrated in FIG. 19B, the position indicated by the black arrow in the image density distribution, that is, the position between the light-receiving elements 72-32 and 72-33 of the density sensor 70 is the detection result center position.

Next, the deviation correction unit 192 calculates the positional deviation of the detection result based on the detection result center position and the center position of the correction pattern under no sheet deviation (S2-13-3).

Specifically, the deviation correction unit 192 preliminarily stores, for example, in the storing unit 210, which position of the light-receiving elements 72 correspond to the center position of the correction pattern (correction pattern center position) under no sheet deviation. In other words, in this case, when the storing unit 210 preliminarily stores information indicating that the correction pattern center position is "between 72-31 and 72-32", the deviation correction unit 192 can compares "between 72-31 and 72-32" with "between 72-32 and 72-33" being the detection result center position, thereby determining that the sheet P' being conveyed is deviated by about the width of one light-receiving element 72 to the right in FIGS. 18, 19A, and 19B.

In S2-13-4, the deviation correction unit 192 corrects each result of detection of image density based on the calculated amount of deviation in the main scanning direction (deviation width). In other words, the image density received by each element is defined as the image density detected by the adjacent light-receiving element 72 displaced by one to the left.

The deviation correction unit 192 outputs the corrected data, as a final detection result, to the correction amount calculation unit 182. The detection data can be temporarily stored in the output circuit 75 before being output.

In the correction of sheet deviation described above, the center position of the correction pattern matches the center position of the detection width of the density sensor 70 when the sheet deviation does not occur, but the embodiments of the present disclosure are not limited thereto. That is, under no sheet deviation, the center position of the correction pattern can match a position other than the center position of the detection width of the density sensor 70.

In addition, in the correction of sheet deviation described above, the correction pattern center position under no sheet deviation is preliminarily stored and compared with the center position in the detection result to determine the sheet deviation. However, the position to be compared can be any predetermined position of the correction pattern. That is, comparison can be made, for example, at the edge position of the correction pattern. Further, in formation of the correction pattern, a pattern for determining a sheet deviation can be separately formed, and the positions thereof can be compared. Alternatively, the pattern for determining the sheet deviation can be formed as a part of the correction pattern, and the positions thereof can be compared.

In the above description, the density sensor 70 is disposed downstream in the sheet conveyance direction from the fixing device 104, to detect the density of an image on the sheet P' (the image bearer) discharged from the fixing device 104, and the correction of uneven density is performed based on the detection result of the sheet P'. Alternatively, the density sensor 70 can be disposed to detect the image density on either the photoconductor or the intermediate transfer belt for the correction of uneven image density.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

an image forming device configured to form an image on an image bearer; and circuitry configured to, receive a selected density level from a user, the selected density level being selected from among a plurality of different density levels, control the image forming device to form the image based on an image forming condition, calculate a density unevenness of the image formed on the image bearer, the density unevenness appearing in a main scanning direction orthogonal to a direction of conveyance of the image bearer during image formation, and correct the density unevenness of the image according to a first correction amount weighted based on the selected density level, the first correction amount being calculated based on a first detected density of the image.

2. The image forming apparatus according to claim 1, further comprising:

a density sensor, wherein the circuitry is configured to, control the image forming device to form the image including a plurality of density unevenness correction patterns having different densities, control the density sensor to detect a plurality of detected densities including a detected density of each of the plurality of density unevenness correction patterns, the plurality of detected densities including the first detected density, calculate the density unevenness of the image by calculating a respective correction amount among a plurality of correction amounts of the image forming condition for each of the plurality of density unevenness correction patterns based on the detected density of each of the plurality of density unevenness correction patterns, the plurality of correction amounts including the first correction amount, each respective correction amount among the plurality of correction amounts being calculated to correct the density unevenness of a corresponding density unevenness correction pattern among the plurality of density unevenness correction patterns, perform weighting of each respective correction amount among the plurality of correction amounts corresponding to each of the plurality of density unevenness correction patterns in accordance with the selected density level to calculate a weighted correction amount of the image forming condition, and correct the density unevenness of the image according to the weighted correction amount.

3. The image forming apparatus according to claim 2, wherein a number of the plurality of density unevenness correction patterns formed is smaller than a number of the plurality of different density levels.

4. The image forming apparatus according to claim 2, wherein the density sensor is configured to detect the plurality of detected densities of the image at a plurality of detection positions to acquire an image density distribution in the main scanning direction, the plurality of detection positions differing in the main scanning direction, wherein the circuitry is configured to, calculate a respective detection result center position for each of the plurality of density unevenness correction patterns based on the image density distribution, the respective detection result center position being a center position in the main scanning direction of each of the plurality of density unevenness correction patterns, calculate a respective amount of deviation between a determined center position and the respective detection result center position for each of the plurality of density unevenness correction patterns, the determined center position being defined in the main scanning direction of each of the plurality of density unevenness correction patterns, displace the plurality of detection positions by the respective amount of deviation in the main scanning direction for each of the plurality of density unevenness correction patterns to generate a respective displaced detection result for each of the plurality of density unevenness correction patterns, and calculate the density unevenness of the image based on a plurality of displaced detection results including the respective displaced detection result for each of the plurality of density unevenness correction patterns.

5. The image forming apparatus according to claim 2, wherein the image forming device includes:

a photoconductor;

a charger configured to charge a surface of the photoconductor;

an exposure device configured to expose the charged surface of the photoconductor to form an electrostatic latent image;

a developing device configured to supply toner to the electrostatic latent image to form a toner image;

a transfer device configured to transfer the toner image onto the image bearer; and a fixing device configured to fix the toner image on the image bearer, wherein the image forming condition is an exposure power of the exposure device.

6. The image forming apparatus according to claim 5, wherein the density sensor is downstream from the fixing device in the direction of conveyance of the image bearer, and configured to detect a density of the image on the image bearer discharged from the fixing device.

7. The image forming apparatus according to claim 1, wherein the circuitry is configured to control the image forming device to form the image including a plurality of sets of density unevenness correction patterns, each of the plurality of sets of density unevenness correction patterns including a plurality of density unevenness correction patterns having different densities.

8. The image forming apparatus according to claim 7, wherein the circuitry is configured to control the image forming device to form each of the plurality of sets of density unevenness correction patterns using a different color toner.

9. The image forming apparatus according to claim 7, wherein each of the plurality of density unevenness correction patterns included in each of the plurality of sets of density unevenness correction patterns is formed to have a respective density level corresponding to one or more of the plurality of different density levels.

10. An image forming apparatus, comprising:

circuitry configured to, receive a selected density level from a user, the selected density level being selected from among a plurality of different density levels, control an image forming device to form an image on an image bearer based on an image forming condition, calculate a density unevenness of the image formed on the image bearer, the density unevenness appearing in a main scanning direction orthogonal to a direction of conveyance of the image bearer during image formation, and correct the density unevenness of the image according to a first correction amount weighted based on the selected density level, the first correction amount being calculated based on a first detected density of the image.

11. The image forming apparatus according to claim 10, wherein the circuitry is configured to:

control the image forming device to form the image including a plurality of density unevenness correction patterns having different densities, a number of the plurality of density unevenness correction patterns formed being smaller than a number of the plurality of different density levels, control a density sensor to detect a plurality of detected densities including a detected density of each of the plurality of density unevenness correction patterns, the plurality of detected densities including the first detected density, calculate the density unevenness of the image by calculating a respective correction amount among a plurality of correction amounts of the image forming condition for each of the plurality of density unevenness correction patterns based on the detected density of each of the plurality of density unevenness correction patterns, the plurality of correction amounts including the first correction amount, each respective correction amount among the plurality of correction amounts being calculated to correct the density unevenness of a corresponding density unevenness correction pattern among the plurality of density unevenness correction patterns, perform weighting of each respective correction amount among the plurality of correction amounts corresponding to each of the plurality of density unevenness correction patterns in accordance with the selected density level to calculate a weighted correction amount of the image forming condition, and correct the density unevenness of the image according to the weighted correction amount.

12. The image forming apparatus according to claim 11, wherein, the density sensor is configured to detect the plurality of detected densities of the image at a plurality of detection positions to acquire an image density distribution in the main scanning direction, the plurality of detection positions differing in the main scanning direction, and the circuitry is configured to, calculate a respective detection result center position for each of the plurality of density unevenness correction patterns based on the image density distribution, the respective detection result center position being a center position in the main scanning direction of each of the plurality of density unevenness correction patterns, calculate a respective amount of deviation between a determined center position and the respective detection result center position for each of the plurality of density unevenness correction patterns, the determined center position being defined in the main scanning direction of each of the plurality of density unevenness correction patterns, displace the plurality of detection positions by the respective amount of deviation in the main scanning direction for each of the plurality of density unevenness correction patterns to generate a respective displaced detection result for each of the plurality of density unevenness correction patterns, and calculate the density unevenness of the image based on a plurality of displaced detection results including the respective displaced detection result for each of the plurality of density unevenness correction patterns.

13. The image forming apparatus according to claim 10, wherein, the circuitry is configured to control the image forming device to form the image including a plurality of sets of density unevenness correction patterns, each of the plurality of sets of density unevenness correction patterns including a plurality of density unevenness correction patterns having different densities, each of the plurality of sets of density unevenness correction patterns being formed using a different color toner, and each of the plurality of density unevenness correction patterns included in each of the plurality of sets of density unevenness correction patterns being formed to have a respective density level corresponding to one or more of the plurality of different density levels.

14. A method performed by circuitry of an image forming apparatus, the method comprising:

receiving a selected density level from a user, the selected density level being selected from among a plurality of different density levels;

controlling an image forming device to form an image on an image bearer based on an image forming condition;

calculating a density unevenness of the image formed on the image bearer, the density unevenness appearing in a main scanning direction orthogonal to a direction of conveyance of the image bearer during image formation; and correcting the density unevenness of the image according to a first correction amount weighted based on the selected density level, the first correction amount being calculated based on a first detected density of the image.

15. The method according to claim 14, further comprising:

controlling the image forming device to form the image including a plurality of density unevenness correction patterns having different densities, a number of the plurality of density unevenness correction patterns formed being smaller than a number of the plurality of different density levels;

controlling a density sensor to detect a plurality of detected densities including a detected density of each of the plurality of density unevenness correction patterns, the plurality of detected densities including the first detected density;

calculating a respective correction amount among a plurality of correction amounts of the image forming condition for each of the plurality of density unevenness correction patterns based on the detected density of each of the plurality of density unevenness correction patterns, the plurality of correction amounts including the first correction amount, each respective correction amount among the plurality of correction amounts being calculated to correct the density unevenness of a corresponding density unevenness correction pattern among the plurality of density unevenness correction patterns; and performing weighting of each respective correction amount among the plurality of correction amounts corresponding to each of the plurality of density unevenness correction patterns in accordance with the selected density level to calculate a weighted correction amount of the image forming condition, wherein, the calculating a density unevenness of the image includes the calculating a respective correction amount, and the correcting corrects the density unevenness of the image according to the weighted correction amount.

16. The method according to claim 15, wherein, the density sensor is configured to detect the plurality of detected densities of the image at a plurality of detection positions to acquire an image density distribution in the main scanning direction, the plurality of detection positions differing in the main scanning direction, the method further comprises, calculating a respective detection result center position for each of the plurality of density unevenness correction patterns based on the image density distribution, the respective detection result center position being a center position in the main scanning direction of each of the plurality of density unevenness correction patterns, calculating a respective amount of deviation between a determined center position and the respective detection result center position for each of the plurality of density unevenness correction patterns, the determined center position being defined in the main scanning direction of each of the plurality of density unevenness correction patterns, displacing the plurality of detection positions by the respective amount of deviation in the main scanning direction for each of the plurality of density unevenness correction patterns to generate a respective displaced detection result for each of the plurality of density unevenness correction patterns, and the calculating the density unevenness of the image calculates the density unevenness of the image based on a plurality of displaced detection results including the respective displaced detection result for each of the plurality of density unevenness correction patterns.

17. The method according to claim 14, further comprising:

controlling the image forming device to form the image including a plurality of sets of density unevenness correction patterns, each of the plurality of sets of density unevenness correction patterns including a plurality of density unevenness correction patterns having different densities, each of the plurality of sets of density unevenness correction patterns being formed using a different color toner, and each of the plurality of density unevenness correction patterns included in each of the plurality of sets of density unevenness correction patterns being formed to have a respective density level corresponding to one or more of the plurality of different density levels.

* * * * *